US009963210B1

(12) United States Patent
Ebot

(10) Patent No.: US 9,963,210 B1
(45) Date of Patent: May 8, 2018

(54) WET SUIT WITH INFLATABLE COMPARTMENTS AND HEATING MEANS

(71) Applicant: Julius-Peters N. Ebot, Green Valley, AZ (US)

(72) Inventor: Julius-Peters N. Ebot, Green Valley, AZ (US)

( * ) Notice: Subject to any disclaimer, the term of this patent is extended or adjusted under 35 U.S.C. 154(b) by 0 days. days.

(21) Appl. No.: 15/244,382

(22) Filed: Aug. 23, 2016

Related U.S. Application Data

(60) Provisional application No. 62/209,045, filed on Aug. 24, 2015.

(51) Int. Cl.

| | |
|---|---|
| ***B63C 9/105*** | (2006.01) |
| ***B63C 9/20*** | (2006.01) |
| ***A41D 13/005*** | (2006.01) |
| ***A41D 13/012*** | (2006.01) |
| ***A41D 1/00*** | (2018.01) |

(52) U.S. Cl.
CPC ..... *B63C 9/1055* (2013.01); *A41D 1/002* (2013.01); *A41D 13/0051* (2013.01); *A41D 13/0125* (2013.01); *B63C 9/20* (2013.01)

(58) Field of Classification Search
CPC ..... B63C 9/087; B63C 9/105; B63C 9/1055; B63C 9/11; B63C 9/125; B63C 9/1255; B63C 11/04; B63C 2011/043; B63C 2011/046; B63C 9/20; A41D 1/002; A41D 1/005; A41D 13/005; A41D 13/0051; A41D 13/012; A41D 13/0125
See application file for complete search history.

(56) References Cited

U.S. PATENT DOCUMENTS

| | | | | |
|---|---|---|---|---|
| 3,675,244 | A * | 7/1972 | Mayo | B63C 11/04 2/2.16 |
| 4,242,769 | A * | 1/1981 | Rayfield | A41D 13/002 2/79 |
| 6,910,931 | B1 * | 6/2005 | Nakase | B63C 9/11 126/204 |
| 6,976,894 | B1 | 12/2005 | Turner | |
| 7,195,369 | B2 * | 3/2007 | Shaw | A41D 13/01 340/573.6 |
| 7,305,715 | B2 | 12/2007 | Orsos | |
| 7,306,403 | B1 * | 12/2007 | Sanders | B63C 11/04 2/2.15 |
| 7,351,126 | B2 | 4/2008 | Turner | |
| 7,699,679 | B2 | 4/2010 | Lahyani | |
| 8,104,096 | B1 | 1/2012 | Jenney | |
| 8,231,421 | B1 | 7/2012 | Hubbard et al. | |
| 8,727,825 | B2 * | 5/2014 | Tsolkas | B63C 9/1055 441/89 |
| 9,381,982 | B1 * | 7/2016 | Sumpter | B63C 9/20 |
| 2005/0020155 | A1 | 1/2005 | Spagnuolo | |

(Continued)

*Primary Examiner* — Ajay Vasudeva
(74) *Attorney, Agent, or Firm* — Aaron R. Cramer; Cramer Patent & Design PLLC

(57) ABSTRACT

A self-inflating wetsuit includes two (2) air chambers within the chest area of the wetsuit. A canister of compressed air is attached to the wetsuit and in fluid communication with the air chambers. The wetsuit has an integrated thermometer capable of reading the temperature of the environment inside and outside the wetsuit. The wetsuit has a battery-operated warming feature and an integrated GPS system so that the wetsuit may be accurately located.

20 Claims, 4 Drawing Sheets

(56) References Cited

U.S. PATENT DOCUMENTS

| | | | | |
|---|---|---|---|---|
| 2009/0114632 | A1* | 5/2009 | Shiue | B63C 9/087<br>219/211 |
| 2010/0015867 | A1 | 1/2010 | Betz et al. | |
| 2011/0009020 | A1 | 1/2011 | Withers et al. | |
| 2015/0210367 | A1* | 7/2015 | Castellanet | H05K 5/065<br>128/201.27 |

* cited by examiner

WET SUIT WITH INFLATABLE COMPARTMENTS AND HEATING MEANS

RELATED APPLICATIONS

The present invention is a Continuation and claims the benefit of U.S. Provisional Application No. 62/209,045, filed on Aug. 24, 2015, the entire disclosures of which are incorporated herein by reference.

FIELD OF THE INVENTION

The present invention relates generally to the field of life jackets and more specifically relates to a wet suit with inflatable compartments and a heating means.

BACKGROUND OF THE INVENTION

Many people love to swim and enjoy outdoor watersports. Swimming in general can be a fun and healthy means to keep an individual physically fit. However; without the proper safety equipment, water related activities can be dangerous. Some of the dangers of swimming come in the form of aquatic animal attacks, capsized vessels, and water-sport accidents. Muscle spasms and exhaustion can also set in during a training session in a small Olympic pool. Several personal floatation systems come in the form of a life preserver, a life vest, and life jacket, etc. All of these flotation devices may hinder movement and may be unwearable in some situations.

Various attempts have been made to solve problems found in life jacket art. Among these are found in: U.S. Pat. No. 7,351,126 to Franklin A. Turner; U.S. Pat. No. 2,306,488 to Georg Morner Hans; and U.S. Pat. No. 5,022,878 to Thomas R. Casad. These prior art references are representative of various types of life preserving means in water environments.

None of the above inventions and patents, taken either singly or in combination, is seen to describe the invention as claimed. Thus, a need exists for a reliable life saver suit, and to avoid the above-mentioned problems.

SUMMARY OF THE INVENTION

The device comprises a wet suit comprising a suit body, a power source, a suit control panel, a compressed air source, an air bladder, an indicator light and a zipper. The suit body comprises a torso portion defining a torso interior which has a superior aperture, a first lateral aperture which is subjacent the superior aperture, a second lateral aperture which is opposite the first lateral aperture, a pelvic aperture which is opposite the superior aperture and a neck portion which has a cuff that is contiguous, central and superjacent to the superior aperture with the cuff partially extending vertically from the superior aperture and in environmental communication with the torso interior.

The suit body also has a first arm portion which comprises a first arm tubular structure that defines a first arm interior and is contiguous with the first lateral aperture. The first arm portion has a first arm first aperture at the first arm tubular structure proximate end and is in environmental communication with the torso interior while a first arm second aperture at the first arm tubular structure distal end is in environmental communication with the first arm interior.

The suit body also has a second arm portion which comprises a second arm tubular structure that defines a second arm interior and is contiguous with the second lateral aperture. The second arm portion has a second arm first aperture at the second arm tubular structure proximate end and is in environmental communication with the torso interior while a second arm second aperture at the second arm tubular structure distal end is in environmental communication with the second arm interior.

The suit body also has a pelvic portion which defines a pelvic interior and is contiguous with the pelvic aperture while being in environmental communication with the torso interior. The pelvic portion comprises a first inferior aperture located off center and opposite the pelvic aperture and a second inferior aperture located opposite the first inferior aperture.

The suit body also has a first leg portion which comprises comprising a first leg tubular structure that defines a first leg interior and is contiguous with the first inferior aperture. The first leg portion has a first leg first aperture at the first leg tubular structure proximate end and is in environmental communication with the pelvic interior while a first leg second aperture at the first leg tubular structure distal end is in environmental communication with the first leg interior.

The suit body also has a second leg portion which comprises a second leg tubular structure which defines a second leg interior and is contiguous with the second inferior aperture. The second leg portion has a second leg first aperture at the second leg tubular structure proximate end and in environmental communication with the pelvic interior while a second leg second aperture is at the second leg tubular structure distal end and is in environmental communication with the second leg interior.

The power source is secured within a lateral portion of the pelvic portion. The suit control panel is secured on an exterior surface of and subjacent to either one (1) of the first or second arm tubular structure distal ends. The suit control panel comprises a suit control panel housing which defines an interior, a plurality of digital displays which are disposed upon the control panel housing and a plurality of switches which are disposed upon the control panel housing. The power source is in electrical communication with the plurality of digital displays and plurality of switches.

The compressed air source is secured to an exterior medial and posterior portion of the torso portion and is in electrical communication with the power source. The air bladder is secured within an anterior portion of the torso portion and is in pneumatic communication with the compressed air source. The indicator light secured to an exterior anterior portion of the torso portion and is in electrical communication with the power source. The zipper begins at a medial, anterior and superior portion of the cuff and terminates at an anterior and inferior portion of the suit at a location which is superjacent to one (1) of the first or second leg tubular structure distal ends. A separate embodiment includes a locator beacon which is coupled with the indicator light and is in electrical communication with the power source. The activation of one (1) of the plurality of switches inflates the air bladder and illuminates the indicator light in the preferred embodiment while in the alternate embodiment the air bladder, indicator light and locator beacon are activated by one (1) of the plurality of switches.

The suit body may also comprise of a foamed neoprene material while the suit may have a pair of air bladders which secured within opposing anterior lateral portions of the torso portion, each being in pneumatic communication with the compressed air source. The indicator light may also be a red laser beam while the control panel may further comprise a GPS unit which is in electrical communication with the indicator light and concurrently activated.

The suit may also comprise a heating means which is capable of selectively heating the suit body. The heating means may comprise of a plurality of heating elements which are disposed within the suit body, a control means which selectively enables activation the heating means which is housed in a unit attached to the suit body and in electrical communication with the plurality of heating elements and at least one thermometer which is disposed within the suit body and is in wireless communication with the control means.

The control means may be either manually or automatically activated. One (1) thermometer may sense an external temperature outside of the suit body or an internal temperature inside the suit body and as a result generates temperature data which is electronically relayed and displayed upon the control panel housing.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
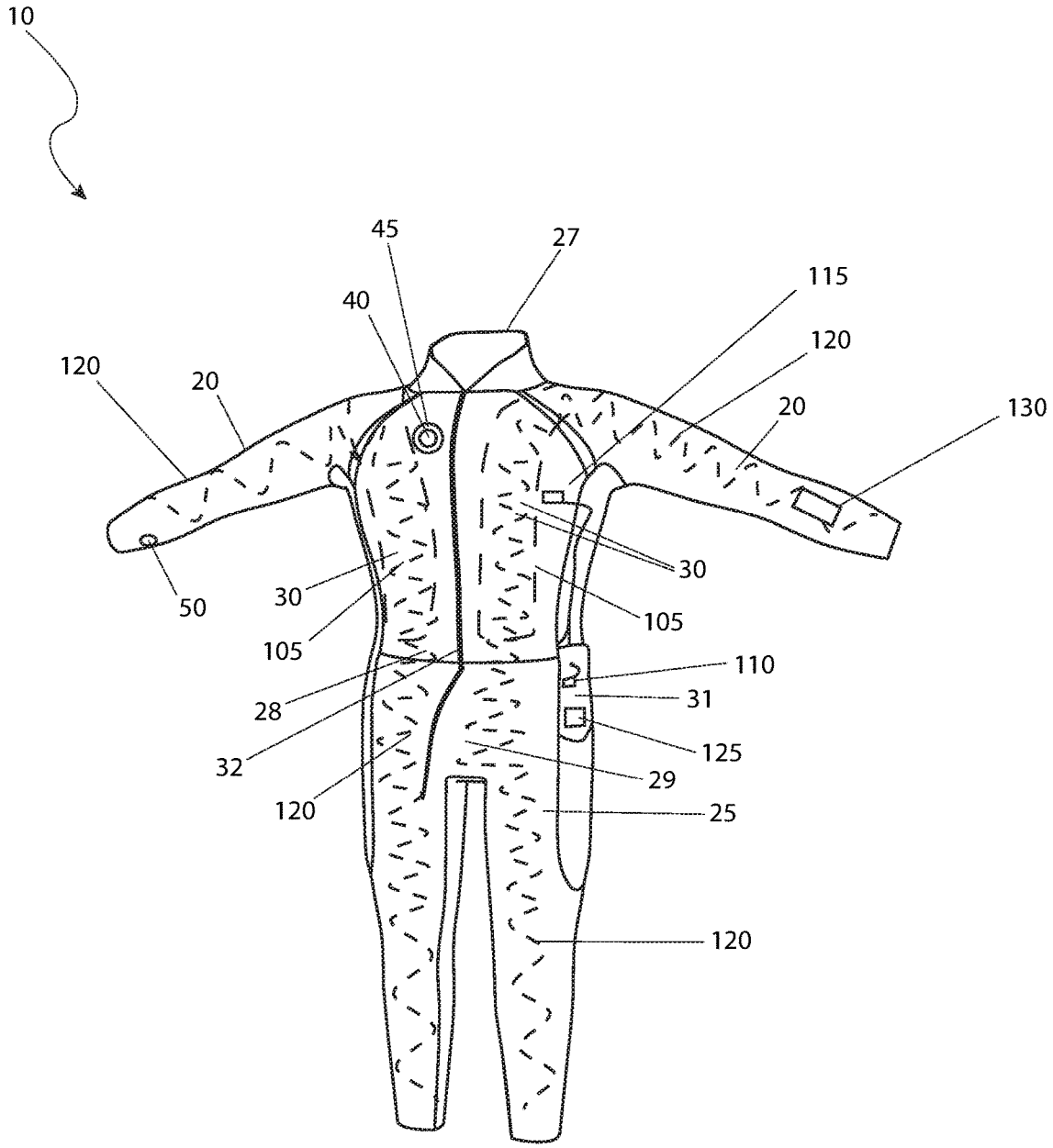
FIG. 1 is a front perspective view of a wet suit 10, according to an embodiment of the present invention.

10 wet suit
20 arm portion
25 leg portion
27 neck portion
28 torso portion
29 pelvic portion
30 air bladder
31 heating means
32 zipper
40 indicator light
45 personal locator beacon
50 activation switch
100 compressed air source
105 air tubing lines
110 exterior temperature sensor
115 body temperature sensor
120 flexible heating elements
125 battery
130 suit control panel
135 exterior temperature meter
140 internal temperature meter
145 auto/manual switch
150 manual temperature control switches

DETAILED DESCRIPTION OF THE PREFERRED EMBODIMENT

Referring now to FIG. 1, front perspective view of a wet suit 10, according to an embodiment of the present invention is depicted. The overall functionality of the wet suit 10 is to permit a conventional wet suit to function as a life preservation device (life vest) in times of distress. In the preferred embodiment of the present invention, the wet suit 10 may comprise a neoprene or similar material. Other suitably equivalent materials may be used. The wet suit 10 comprises a pair of arm portions 20, a neck portion 27, a torso portion 28, a pelvic portion 29, and a leg portion 25 which covers the lower waist and both legs. The wet suit 10 may comprise one (1) or more air bladders 30 located within chambers positioned around the shoulder section of both arm portions 20 adjacent the neck portion 27 and down the front chest section of the torso portion 28. The air bladders 30 are designed to be in fluid communication with a compressed air source 100 (not shown due to illustrative limitations in this FIG.) via a series of air tubing lines 105. The compressed air source 100 may be activated by an activation switch 50 in the form of a toggle, a push button, or a rip cord trigger system housed integral to the wet suit 10 to simultaneously inflate all air bladders 30. The air bladders 30, when inflated, are designed to keep the wearer's head and upper chest area above the water line until emergency personal can arrive via buoyancy. The activation switch 50 is preferably located near the wrist section of one (1) of the arm portions 20 or otherwise located in a position easily reached by the wearer.

The wet suit 10 is intended to keep swimmers, divers, and aquatic sports users afloat and may be donned by a user by accessing the interior of the wet suit 10 by use of a zipper 32. It may also allow a wearer that is extremely fatigued or incapacitated to float without the use of their arms or legs. The wet suit 10 may help regulate body temperature. This is achieved by using a one-way breathable material, where cold is reflected and heat may be sustained while in water awaiting rescue. The wet suit 10 may be made of foamed neoprene or other similar breathable material to provide excellent insulation against cold water and weather; also, helps insulate the temperature of the wearer. When the air bladders 30 are deflated, they are positioned within the wet suit 10, 15 such that the wearer is unencumbered and allow for a full range of normal motion to be achieved Water-skiing and surfing among other similar water-sports requires a great amount of mobility. The wet suit 10 may not hinder movement while engaging in water sports or activities. An indicator light 40 is located on a chest section of the torso portion 28 and is able to serve as a location marker for emergency services. The indicator light 40 is preferably a red laser beam having capabilities to allow the beam to be seen up twelve miles (12 mi.) away with the naked eye. The indicator light 40 is preferably a red beam but an alternative may be used. The system may be especially effective in night rescues situations as wet suits 10 and ambient environment are generally black. It is preferred that the indicator light 40 is activated concurrently with the compressed air source.

Alternate embodiments and features may be appreciated for the present invention. A personal locator beacon 45 (PLB) unit may be integrated with the indicator light 40. Such a combined PLB 45, and indicator light 40 can also be located on other locations of the wet suit 10. The PLB 45, transmits a powerful signal which is in an internationally recognized distress frequency monitored in the U.S. by NOAA (National Oceanic and Atmospheric Administration) and the AFRCC (Air Force Rescue Coordination Center). The PLB also communicates with a network of international satellites. The signal provides unique information regarding the location of the PLB to any monitoring authority.

A further alternate embodiment that may be appreciated for the present invention is that of a heating means 31. An exterior temperature sensor 110 can sense the outside temperature and a body temperature sensor 115 can sense the temperature inside the wet suit 10. Both the exterior temperature sensor 110 and the body temperature sensor 115 can be located on any location of the wet suit 10, and are limited to the locations as depicted. The heating means 31 is in electrical communication with a series of flexible heating elements 120 (shown by phantom lines to depict interior location). The heating means is powered by a battery 125 located on the interior of the heating means 31. Finally, operation and control of the heating means 31 is provided by a suit control panel 130, located near the wrist section of one (1) of the arm portions 20 or otherwise located in a position easily reached by the wearer. Further description and operation of the suit control panel 130 will be provided herein below.

Figure 2:
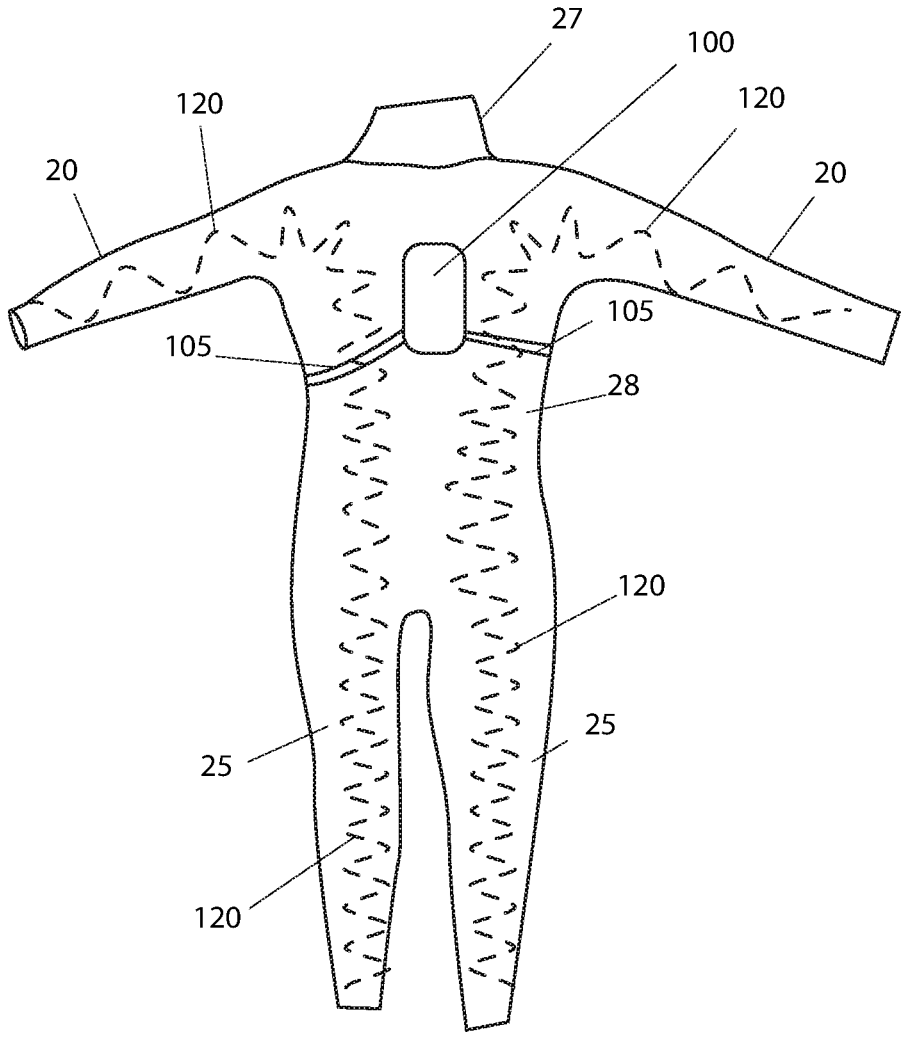
FIG. 2 is a rear perspective of the wet suit 10, according to the preferred embodiment of the present invention.

Referring next to FIG. 2, a rear perspective of the wet suit 10, according to the preferred embodiment of the present invention is disclosed. This figure provides an overall understanding of the components of the wet suit 10 as such as the arm portions 20, the neck portion 27, the torso portion 28, pelvic portion 29, and the leg portion 25 which covers the lower waist and both legs. The compressed air source 100 is visible at the mid-section of the user's back area. The compressed air source 100 is envisioned as either a mechanical air compressor, a pressurized air tank, a chemical based air inflation system (similar to those utilized on motor vehicle air bag systems) or the like. The inclusion or deletion of any particular style of compressed air source 100 is not intended to be a limiting factor of the present invention. The air tubing lines 105 provide pressurized air to the air bladder(s) 30 (as shown in FIG. 1). Additionally, the flexible heating elements 120 (shown by phantom lines to depict interior location) are also shown in FIG. 2 to provided warmth to the rear part of the wearer's body should it be required.

Figure 3:
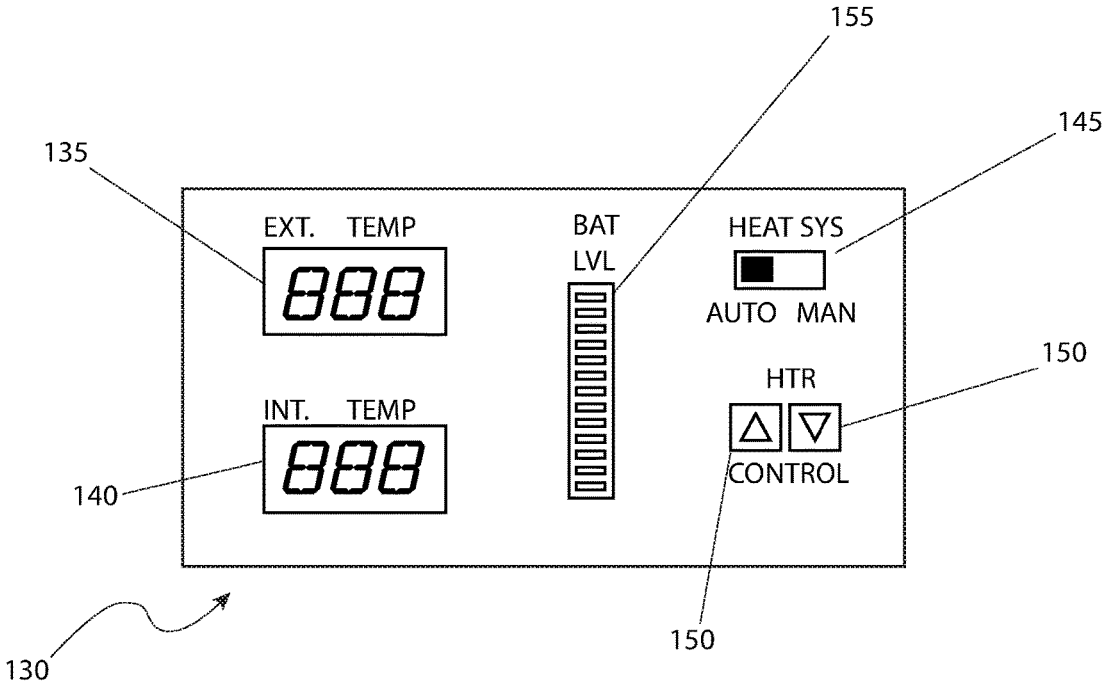
FIG. 3 is a detailed view of the suit control panel 130 as used with the wet suit 10 according to the preferred embodiment of the present invention; and, FIG. 4 is an electrical block diagram depicting the major electrical components of the wet suit 10, according to the preferred embodiment of the present invention.

Referring now to FIG. 3, a detailed view of the suit control panel 130 as used with the wet suit 10 according to the preferred embodiment of the present invention is shown. The suit control panel 130 comprises all waterproof electrical components. To provide indication of relative temperatures, an external temperature meter 135 and an internal temperature meter 140 are provided. Such meters 135, 140 are utilized by the user to determine relative water temperature and the ability to avoid hypothermia and other cold temperature related illnesses. The heating system is provided with an auto/manual switch 145 to either allow the wet suit 10 to control body temperature based upon standardized guidelines deemed as life sustaining, or for manual operation for maximum user comfort. In the manual operation mode, the user would utilize manual temperature control switches 150 to adjust operation of the flexible heating elements 120 (as shown in FIG. 1 and FIG. 2). Relative operation of the manual temperature control switches 150 will be reflected in the internal temperature meter 140 after an appropriate operating cycle time Finally, a battery level meter 155 is provided to allow the user to make decisions on operation of the heating system based upon health of the battery 125 (not shown in this figure).

Figure 4:
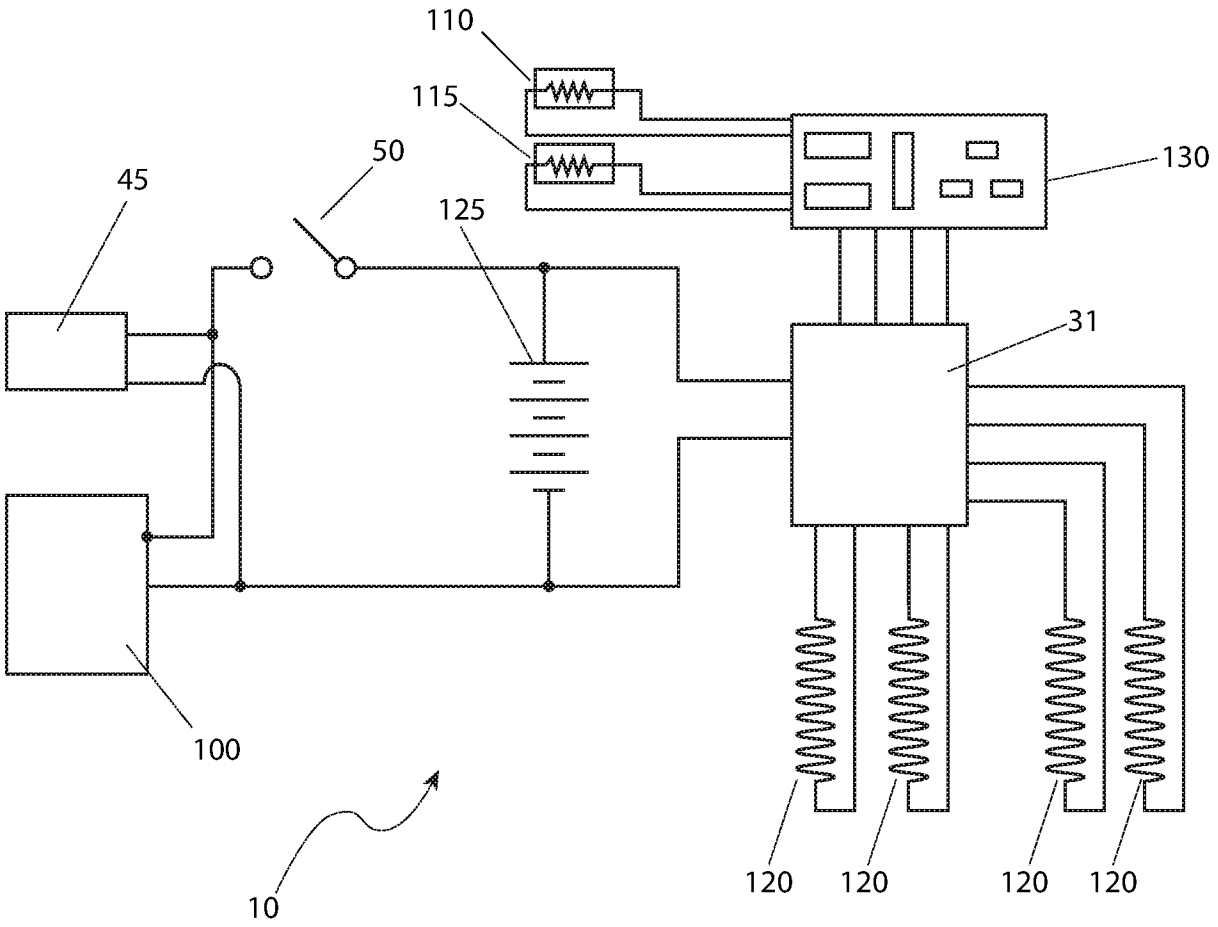

Referring finally to FIG. 4, an electrical block diagram depicting the major electrical components of the wet suit 10, according to the preferred embodiment of the present invention is depicted. The battery 125 is envisioned to be a long life-high capacity type such as lithium powered or equal. It can be recharged externally if desired during periods of non-use of the wet suit 10. The battery provides power to the personal locator beacon 45 and the compressed air source 100 through the activation switch 50. Likewise, the battery 125 provides power to the heating means 31. The heating means 31 is in electrical communication with the suit control panel 130. The suit control panel 130 receives signal inputs from both the exterior temperature sensor 110 and the body temperature sensor 115. A resultant power output from the heating means 31 is used to drive the flexible heating elements 120 in a parallel configuration.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A wet suit, comprising:

a suit body, comprising:

a torso portion defining a torso interior comprising:

a superior aperture;

a first lateral aperture subjacent said superior aperture;

a second lateral aperture opposite said first lateral aperture;

a pelvic aperture opposite said superior aperture;

a neck portion having a cuff contiguous, central and superjacent to said superior aperture with said cuff partially extending vertically from said superior aperture and in environmental communication with said torso interior;

a first arm portion comprising a first arm tubular structure defining a first arm interior, contiguous with said first lateral aperture, having a first arm first aperture at said first arm tubular structure proximate end and in environmental communication with said torso interior and a first arm second aperture at said first arm tubular structure distal end and in environmental communication with said first arm interior;

a second arm portion comprising a second arm tubular structure defining a second arm interior, contiguous with said second lateral aperture, having a second arm first aperture at said second arm tubular structure proximate end and in environmental communication with said torso interior and a second arm second aperture at said second arm tubular structure distal end and in environmental communication with said second arm interior;

a pelvic portion defining a pelvic interior contiguous with said pelvic aperture and in environmental communication with said torso interior comprising:

a first inferior aperture located off center and opposite said pelvic aperture; and, a second inferior aperture located opposite said first inferior aperture;

a first leg portion comprising a first leg tubular structure defining a first leg interior, contiguous with said first inferior aperture, having a first leg first aperture at said first leg tubular structure proximate end and in environmental communication with said pelvic interior and a first leg second aperture at said first leg tubular structure distal end and in environmental communication with said first leg interior; and, a second leg portion comprising a second leg tubular structure defining a second leg interior, contiguous with said second inferior aperture, having a second leg first aperture at said second leg tubular structure proximate end and in environmental communication with said pelvic interior and a second leg second aperture at said second leg tubular structure distal end and in environmental communication with said second leg interior;

a power source secured within a lateral portion of said pelvic portion;

a suit control panel secured on an exterior surface of and subjacent to one of said first and second arm tubular structure distal ends comprising:

a suit control panel housing defining an interior;

a plurality of digital displays disposed upon said control panel housing; and, a plurality of switches disposed upon said control panel housing;

wherein said power source is in electrical communication with said plurality of digital displays; and, wherein said power source is in electrical communication with said plurality of switches;

a compressed air source secured to an exterior medial and posterior portion of said torso portion and in electrical communication with said power source;

an air bladder secured within an anterior portion of said torso portion and in pneumatic communication with said compressed air source;

an indicator light secured to an exterior anterior portion of said torso portion in electrical communication with said power source;

a zipper beginning at a medial, anterior and superior portion of said cuff and terminating at an anterior and inferior portion of said suit superjacent one of said first or second leg tubular structure distal ends; and, an activation switch secured on an exterior surface of the other of said first and second arm tubular structures distal ends, wherein activation of said activation switch inflates said air bladder and illuminates said indicator light.

2. The suit of claim 1, wherein said suit body further comprising a foamed neoprene material.

3. The suit of claim 1, further comprising a pair of air bladders secured within opposing anterior lateral portions of said torso portion, each in pneumatic communication with said compressed air source.

4. The suit of claim 1, wherein said indicator light is a red laser beam.

5. The suit of claim 1, wherein said control panel further comprises a GPS unit in electrical communication with said indicator light and activated concurrently therewith.

6. The suit of claim 1, further comprising a heating means for selectively heating said suit body comprising:

a plurality of heating elements disposed within said suit body;

a control means for selectively activating said heating means housed in a unit attached to said suit body and in electrical communication with said plurality of heating elements; and, at least one thermometer disposed within said suit body and in wireless communication with said control means.

7. The suit of claim 6, wherein said control means is manually activated.

8. The suit of claim 6, wherein said control means is automatically activated upon said thermometer sensing a setpoint temperature.

9. The suit of claim 6, wherein one thermometer senses an external temperature outside of said suit body and generates temperature data wherein said temperature data is electronically relayed and displayed upon said control panel housing.

10. The suit of claim 6, wherein one thermometer senses an internal temperature outside of said suit body and generates temperature data wherein said temperature data is electronically relayed and displayed upon said control panel housing.

11. A wet suit, comprising:

a suit body, comprising:

a torso portion defining a torso interior comprising:

a superior aperture;

a first lateral aperture subjacent said superior aperture;

a second lateral aperture opposite said first lateral aperture;

a pelvic aperture opposite said superior aperture;

a neck portion having a cuff contiguous, central and superjacent to said superior aperture with said cuff partially extending vertically from said superior aperture and in environmental communication with said torso interior;

a first arm portion comprising a first arm tubular structure defining a first arm interior, contiguous with said first lateral aperture, having a first arm first aperture at said first arm tubular structure proximate end and in environmental communication with said torso interior and a first arm second aperture at said first arm tubular structure distal end and in environmental communication with said first arm interior;

a second arm portion comprising a second arm tubular structure defining a second arm interior, contiguous with said second lateral aperture, having a second arm first aperture at said second arm tubular structure proximate end and in environmental communication with said torso interior and a second arm second aperture at said second arm tubular structure distal end and in environmental communication with said second arm interior;

a pelvic portion defining a pelvic interior contiguous with said pelvic aperture and in environmental communication with said torso interior comprising:

a first inferior aperture located off center and opposite said pelvic aperture; and, a second inferior aperture located opposite said first inferior aperture;

a first leg portion comprising a first leg tubular structure defining a first leg interior, contiguous with said first inferior aperture, having a first leg first aperture at said first leg tubular structure proximate end and in environmental communication with said pelvic interior and a first leg second aperture at said first leg tubular structure distal end and in environmental communication with said first leg interior; and, a second leg portion comprising a second leg tubular structure defining a second leg interior, contiguous with said second inferior aperture, having a second leg first aperture at said second leg tubular structure proximate end and in environmental communication with said pelvic interior and a second leg second aperture at said second leg tubular structure distal end and in environmental communication with said second leg interior;

a power source secured within a lateral portion of said pelvic portion;

a suit control panel secured on an exterior surface of and subjacent to one of said first and second arm tubular structure distal ends comprising:

a suit control panel housing defining an interior;

a plurality of digital displays disposed upon said control panel housing; and, a plurality of switches disposed upon said control panel housing;

wherein said power source is in electrical communication with said plurality of digital displays; and, wherein said power source is in electrical communication with said plurality of switches;

a compressed air source secured to an exterior medial and posterior portion of said torso portion and in electrical communication with said power source;

an air bladder secured within an anterior portion of said torso portion and in pneumatic communication with said compressed air source;

an indicator light secured to an exterior anterior portion of said torso portion in electrical communication with said power source;

a locator beacon coupled with said indicator light and in electrical communication with said power source;

a zipper beginning at a medial, anterior and superior portion of said cuff and terminating at an anterior and inferior portion of said suit superjacent one of said first or second leg tubular structure distal ends; and, an activation switch secured on an exterior surface of the other of said first and second arm tubular structure distal ends, wherein activation of said activation switch inflates said air bladder and illuminates said indicator light.

12. The suit of claim 11, wherein said suit body further comprising a foamed neoprene material.

13. The suit of claim 11, further comprising a pair of air bladders secured within opposing anterior lateral portions of said torso portion, each in pneumatic communication with said compressed air source.

14. The suit of claim 11, wherein said indicator light is a red laser beam.

15. The suit of claim 11, wherein said control panel further comprises a GPS unit in electrical communication with said indicator light and activated concurrently therewith.

16. The suit of claim 11, further comprising a heating means for selectively heating said suit body comprising:

a plurality of heating elements disposed within said suit body;

a control means for selectively activating said heating means housed in a unit attached to said suit body and in electrical communication with said plurality of heating elements; and, at least one thermometer disposed within said suit body and in wireless communication with said control means.

17. The suit of claim 16, wherein said control means is manually activated.

18. The suit of claim 16, wherein said control means is automatically activated upon said thermometer sensing a setpoint temperature.

19. The suit of claim 16, wherein one thermometer senses an external temperature outside of said suit body and generates temperature data wherein said temperature data is electronically relayed and displayed upon said control panel housing.

20. The suit of claim 16, wherein one thermometer senses an internal temperature outside of said suit body and generates temperature data wherein said temperature data is electronically relayed and displayed upon said control panel housing.

* * * * *